US008210387B2

(12) United States Patent
Twig et al.

(10) Patent No.: US 8,210,387 B2
(45) Date of Patent: Jul. 3, 2012

(54) ORGANIZER

(75) Inventors: Noam Twig, Petach Tikva (IL); Gil Vilkomirski, Petach-Tiqwa (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 308 days.

(21) Appl. No.: 12/576,816

(22) Filed: Oct. 9, 2009

(65) Prior Publication Data

US 2011/0084078 A1 Apr. 14, 2011

(51) Int. Cl.
*B65D 85/00* (2006.01)
*B65D 43/24* (2006.01)

(52) U.S. Cl. ..... 220/521; 220/831

(58) Field of Classification Search ..... 206/373, 206/372, 349; 220/507, 23.89, 23.88, 522, 220/831, 810, 817, 4.23, 4.22, 530, 529, 220/771, 752, 636, 631, 629, 628, 600, 212, 220/4.01; 211/10; *B65D 1/24, 43/24*
See application file for complete search history.

(56) References Cited

U.S. PATENT DOCUMENTS

| | | | | |
|---|---|---|---|---|
| 417,979 | A * | 12/1889 | Borcherdt | 43/57.1 |
| 1,554,161 | A | 9/1925 | Hubbard | |
| 1,933,894 | A | 11/1933 | Clink | |
| 2,008,429 | A * | 7/1935 | Weatherhead, Jr. | 220/520 |
| 2,379,254 | A * | 6/1945 | Rathbun | 220/817 |
| 2,687,157 | A * | 8/1954 | Cowan | 220/4.23 |
| 2,697,460 | A * | 12/1954 | Barnett | 144/285 |
| 3,310,905 | A | 3/1967 | Davis et al. | |
| 3,327,841 | A | 6/1967 | Schurman et al. | |
| 3,978,782 | A * | 9/1976 | Werling | 99/446 |
| 4,619,363 | A | 10/1986 | Wolfseder | |
| 4,836,374 | A | 6/1989 | Hutchins et al. | |
| 4,927,021 | A | 5/1990 | Taylor | |
| 4,934,549 | A * | 6/1990 | Allen | 220/4.24 |
| 5,022,546 | A | 6/1991 | Bock | |

(Continued)

FOREIGN PATENT DOCUMENTS

CA 2 303 551 9/2001

(Continued)

OTHER PUBLICATIONS

Extended Search Report as issued for European Patent Application No. 10186964.2, dated Jun. 1, 2011.

*Primary Examiner* — Mickey Yu
*Assistant Examiner* — Robert J Hicks
(74) *Attorney, Agent, or Firm* — Pillsbury Winthrop Shaw Pittman LLP

(57) ABSTRACT

A container having a container portion with an interior space in which articles to be transported can be stored and a lid pivotably connected to the container portion. The lid is moveable relative to the container portion between an opened and closed position. The container also includes a latch arrangement that is constructed to secure the lid in covering relation with respect to the container portion and a hinge structure that is constructed to enable the lid to pivot relative to the container portion. The container includes a support that engages a surface on which a bottom surface rests when the lid is in the opened position, so as to support the lid in the open position. The support is positioned proximate to the container portion when the lid is in the closed position and movable to an extended position when the lid is in the open position.

14 Claims, 6 Drawing Sheets

U.S. PATENT DOCUMENTS

| | | | | |
|---|---|---|---|---|
| 5,325,966 | A | 7/1994 | Chang | |
| 5,699,925 | A | 12/1997 | Petruzzi | |
| 5,803,254 | A | 9/1998 | Vasudeva | |
| 5,882,097 | A | 3/1999 | Kohagen et al. | |
| 5,887,715 | A | 3/1999 | Vasudeva | |
| 5,915,554 | A | 6/1999 | Hung | |
| 5,934,466 | A | 8/1999 | Loeffler | |
| D417,338 | S | 12/1999 | Main | |
| 6,015,064 | A | 1/2000 | Liu | |
| 6,105,767 | A | 8/2000 | Vasudeva | |
| 6,260,700 | B1 * | 7/2001 | Huang | 206/373 |
| 6,371,320 | B2 | 4/2002 | Sagol | |
| 6,523,687 | B2 | 2/2003 | Ling | |
| 6,626,295 | B1 | 9/2003 | Vasudeva | |
| 6,648,166 | B2 | 11/2003 | Levy | |
| 6,889,838 | B2 | 5/2005 | Meier et al. | |
| 6,971,517 | B2 | 12/2005 | Chen | |
| 6,994,214 | B2 | 2/2006 | Yang | |
| D536,525 | S | 2/2007 | Vasudeva et al. | |
| 7,219,969 | B2 | 5/2007 | Bezzubov | |
| 7,246,704 | B2 | 7/2007 | Brunson et al. | |
| 7,255,229 | B2 | 8/2007 | Roesler | |
| 7,334,680 | B2 | 2/2008 | Cunningham et al. | |
| 7,357,268 | B2 | 4/2008 | Yang | |
| 7,472,730 | B2 | 1/2009 | Adkins | |
| 7,523,827 | B2 | 4/2009 | Dane et al. | |
| 2004/0069668 | A1 | 4/2004 | Finnigan | |
| 2005/0161357 | A1 | 7/2005 | Allan et al. | |
| 2005/0224384 | A1 | 10/2005 | Sands et al. | |
| 2006/0037964 | A1 | 2/2006 | Su | |
| 2007/0033858 | A1 * | 2/2007 | Marino | 43/54.1 |
| 2007/0103039 | A1 | 5/2007 | Holcomb et al. | |
| 2007/0194024 | A1 | 8/2007 | Liaw | |
| 2007/0272572 | A1 | 11/2007 | Chen | |
| 2010/0000893 | A1 * | 1/2010 | Twig et al. | 206/373 |

FOREIGN PATENT DOCUMENTS

| | | |
|---|---|---|
| DE | 23 03 235 | 8/1973 |
| DE | 101 54 998 | 6/2003 |
| EP | 0 668 129 | 8/1995 |
| GB | 344895 | 3/1931 |
| GB | 2 183 289 | 6/1987 |

* cited by examiner

ORGANIZER

FIELD OF THE INVENTION

The present invention relates to an organizer, and more particularly, to an organizer for storing and carrying objects.

BACKGROUND OF THE INVENTION

Numerous organizers or storage containers are known in the art. However, there is a constant need in the industry to improve upon existing organizers by making them more efficient and easy to use.

SUMMARY OF THE INVENTION

One aspect provides a container having a container portion with an interior space in which articles to be transported can be stored. The container further includes a lid that is pivotably connected to the container portion. The lid is moveable relative to the container portion between an opened position and a closed position to permit and prevent access to the interior space, respectively. The container also includes a latch arrangement that is constructed to secure the lid in covering relation with respect to the container portion and a hinge structure that is constructed to enable the lid to pivot relative to the container portion. The container further includes a support that is constructed and arranged to engage a surface on which a bottom surface rests when the lid is in the opened position, so as to support the lid in the open position. The support is constructed and arranged to be positioned proximate to the container portion when the lid is in the closed position and movable to an extended position when the lid is in the open position.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment, the structural components illustrated herein can be considered drawn to scale. It is to be expressly understood, however, that the drawings are for the purpose of illustration and description only and are not a limitation of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

DETAILED DESCRIPTION OF THE INVENTION

Figure 1:
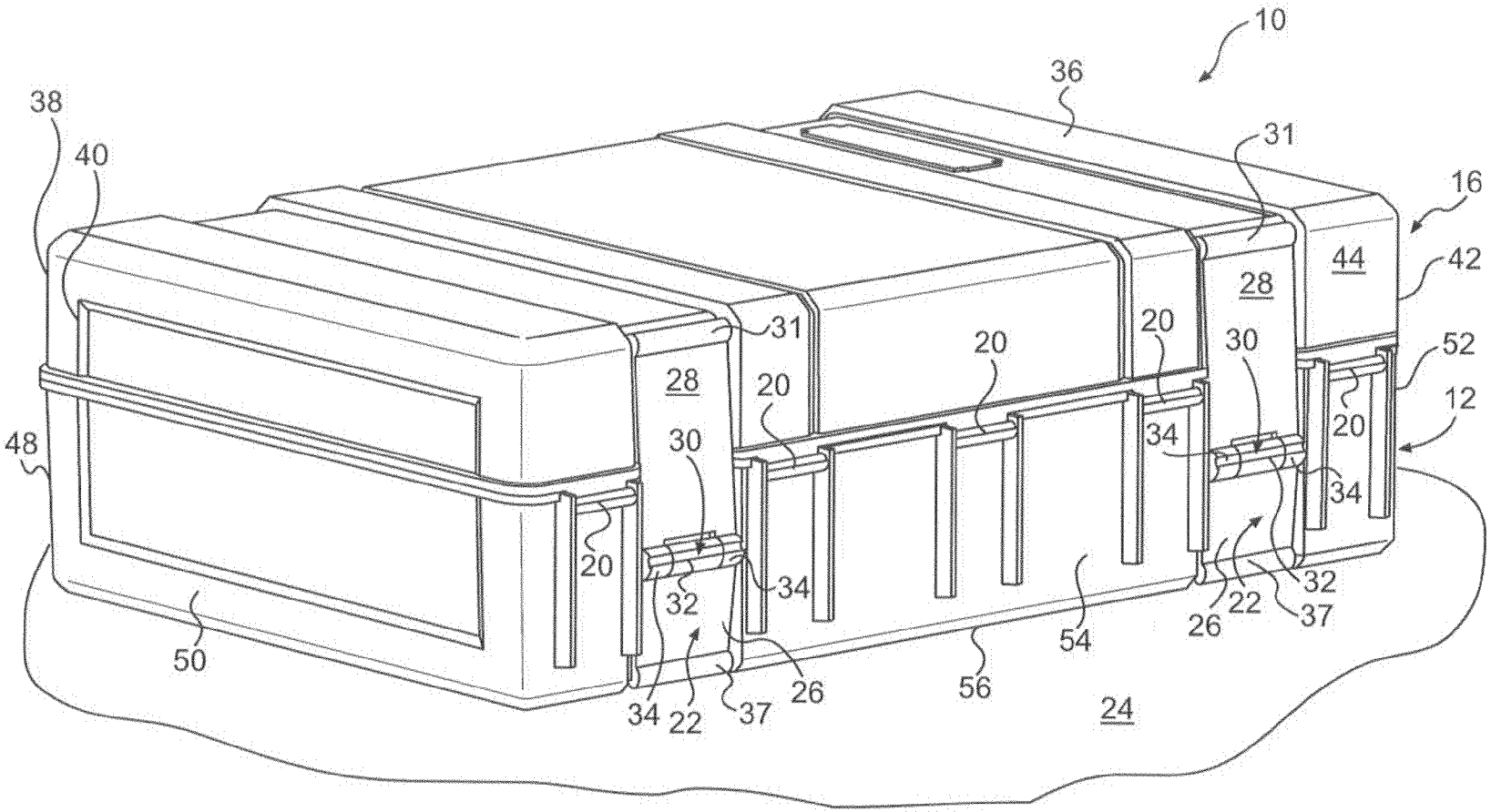
FIG. 1 is a perspective rear view of an organizer in a closed position in accordance with an embodiment of the present invention.

FIG. 1 shows a container 10 having a container portion 12 with an interior space 14 (see FIG. 2) in which articles to be transported can be stored. The container 10 further includes a lid 16 that is pivotably, connected to the container portion 12. The lid 16 is moveable relative to the container portion 12 between an opened position and a closed position to permit and prevent access to the interior space 14, respectively. The container 10 also includes a latch arrangement 18 (see FIG. 4) that is constructed to secure the lid 16 in covering relation with respect to the container portion 12 and one or more hinge structure(s) 20 that is constructed to enable the lid 16 to pivot relative to the container portion 12. The container 10 further includes a support 22 that is constructed and arranged to engage a surface 24 on which a bottom surface of the container 10 rests when the lid 16 is in the opened position, so as to support the lid 16 in the open position. The support 22 is positioned proximate to the container portion 12 when the lid 16 is closed (see FIG. 1), and is movable to an extended position when the lid 16 is in the open position (see FIG. 2).

As shown in FIG. 1, the lid 16 may include a top wall or side 36, a front wall or side 38, a right wall or side 40, a left wall or side 42, and a back wall or side 44. The lid 16 may also include an interior space 46 in which articles can be stored (see FIG. 6). The container wall or side 12 may include a front wall or side 48, a right wall or side 50, a left wall or side 52, a back wall or side 54, and a bottom wall or side 56. The bottom wall or side 56 may be constructed and arranged to engage the surface 24 when the lid is in the opened position. The container 10 may include a handle 57 (see FIG. 4) constructed and arranged to enable the user to lift and carry the container 10. A depression 67 in the front wall 48 may be constructed and arranged to receive the handle 57 when the handle 57 is not in use. The handle 57 may be pivotably attached to the front wall 48 of the container 10 via pins 85. When the handle 57 is to be used, the handle 57 may be pivoted away from the depression 67 to a position wherein the handle 57 is generally perpendicular to a plane defined by the front wall 48. Grooves may be formed on the surface thereof so as to facilitate the grasping of the handle 57. Rubber or other anti-friction materials may optionally be provided on the surface thereof. The handle 57 may optionally be attached to the container 10 via hinges, snap-fit connections, or other connecting mechanisms. The lid 16, container portion 12, and/or any other parts of the container 10 may be made of plastic, metal, wood, other materials, or any combination thereof. The lid 16, container portion 12, and/or other parts of the container 10 may optionally be made from molded plastic.

The hinge structure(s) 20 may comprise any type of pivotal arrangement, such as, for example, a living hinge or pins and hoops. Although, in one embodiment, the hinge structure(s) 20 may have a permanent connection, a permanent connection is not required. It is contemplated that in some embodiments, a particular hinge structure 20 may be disconnected such that the lid 16 and the container portion 12 are no longer attached by the hinge structure 20. Accordingly, if the hinge 20 is disconnected, the lid 16 may be pivoted to a position wherein the top wall 36 of the lid 16 rests on the surface 24 when the bottom wall 56 of the container portion 12 also rests on the surface 24. In this position, the top wall 36 of the lid 16 and the bottom wall 56 of the container 12 may generally lie along the same plane.

In the embodiment shown in FIG. 1, the support 22 may include support portion 26 and support portion 28. Support portion 26 may be pivotably connected to the lid 16 via hinge or pivotal connection 31. Similarly, support portion 28 may be pivotably connected to the container portion 12 via hinge or pivotal connection 37. The hinges 31, 37 may comprise any type of pivotal arrangement, such as, for example, pins that extend through loops or openings in the associated portions of the container, portion 12 and the support 22. It is contemplated that the hinges 31, 37 do not necessarily require a permanent connection. It is also contemplated that the hinges 31, 37 may be disconnected from the lid 16 and the container portion 12, respectively. As such, this may enable the lid 16 to tilt backwards so that the top wall 36 of the lid 16 may rest on the surface 24 when the bottom wall 56 of the container portion 12 also rests on the surface 24. As mentioned above, in this position, the top wall 36 of the lid 16 and the bottom wall 56 of the container 12 may generally lie along the same plane. A hinge or pivotal connection 30 is constructed and arranged to enable support portion 26 and support portion 28 to pivot relative to each other. In one embodiment, the hinge 30 may include a middle portion 32 connected to support portion 28 and side portions 34 connected to support portion 26, or vice versa. The main portion 32 and the side portions 34 of the hinge 30 may be pivotably engaged to one another so to as enable the support portions 26, 28 to pivot relative to each other. The container portion 12 and the lid 16 may have depressions 33 (see FIG. 2) formed therein that are constructed and arranged to receive the support 22 when the lid 16 is in the closed position relative to the container portion 12. It is contemplated that the hinges 30 may have other configurations, or that support portion 26 and support portion 28 may be pivotable using pins or any other pivot mechanisms. Although the embodiment in FIG. 1 shows only two supports 22, it is contemplated that the number and location of the supports 22 may vary in other embodiments.

In one embodiment, the hinge 30 may optionally be disconnected, thus disconnecting support portion 26 from support portion 28. In the embodiment shown in FIG. 1, the hinge 30 may be disconnected by disconnecting main portion 32 from the side portions 34. It is also contemplated that in some embodiments, one or any combination of hinges or pivotal connections 20, 31, 37, and 30 may optionally be disconnected. In one embodiment, the hinges 20 and any combination of the hinges 31, 37, and 30 may be disconnected so that the lid 16 and container portion 12 can be removed and carried separately.

Figure 2:
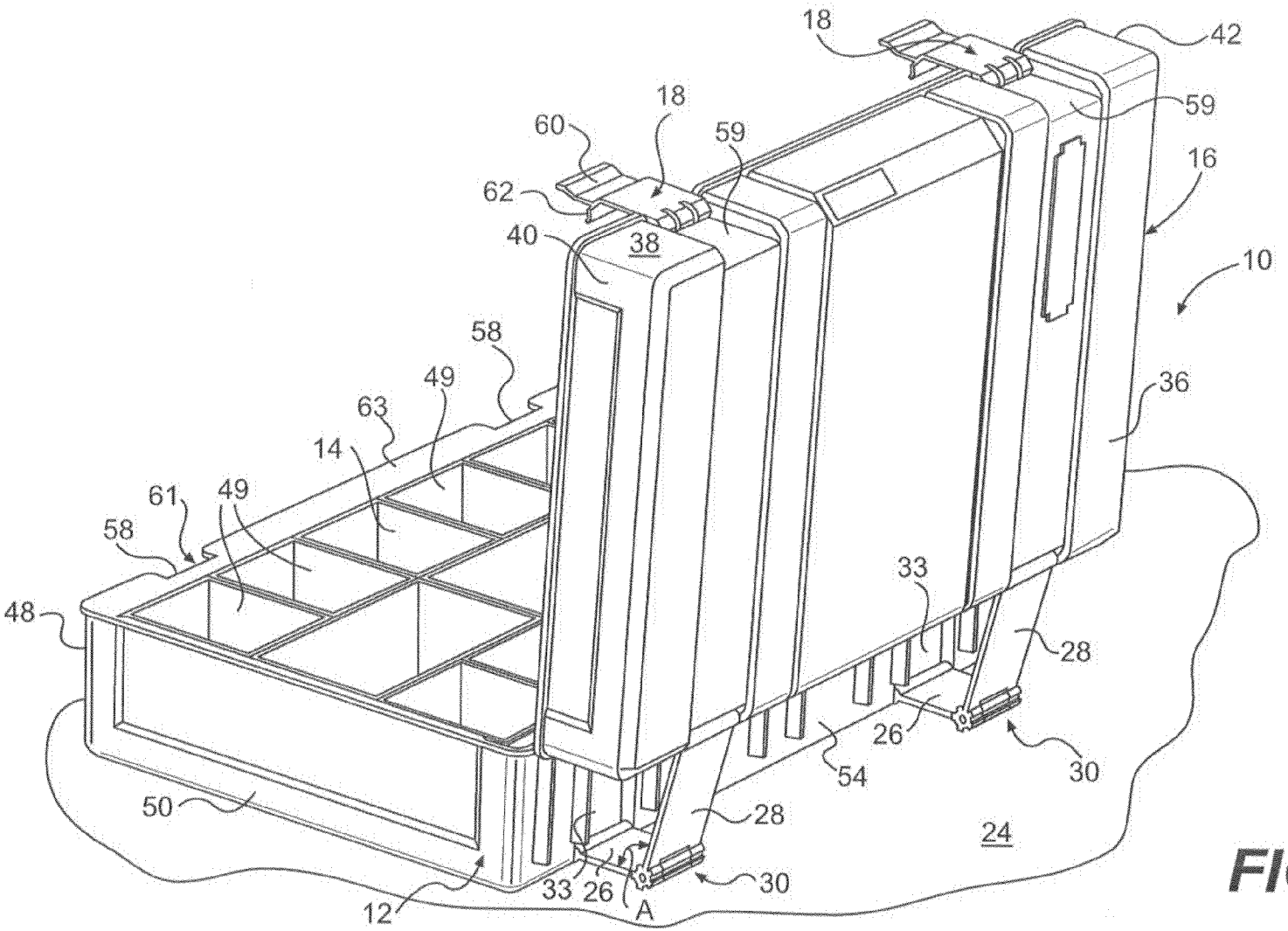
FIG. 2 is a perspective rear view of the organizer in accordance with the embodiment of FIG. 1.

In the embodiment shown in FIG. 2, the lid 16 is pivotable between a closed position (see FIG. 1) and an open position. When the lid 16 is in the open position, a user may access the contents of the interior space 14 of the container portion 12. To move the lid 16 to the open position, the lid 16 is pivoted about the hinge structure(s) 20 that pivotally connect lid 16 with container portion 12. In addition, during this motion, the support 22 (and particularly portion 30 thereof) moves away from the container portion 12 and lid 16, as shown, by pivoted movements of support portions 26 and 28 about the hinges 31, 37, and 30.

In this open position, the lid 16 is pivoted at an angle that is greater than 90 degrees relative to the container portion 12. Due to the engagement of the support 22 with surface 24, the lid portion 16 is able to carry contents of an increased weight without the container 10 falling over backwards, in comparison with a container that does not have a support structure as contemplated herein. In another embodiment, the support 22 may simply be a structure attached to the lid 16 and not container portion 12, and still provide the support function as noted above. For example, the support 22 can be one or more linearly slidable or pivotable rods or legs that can be manually moved to an extended position when the lid 16 is open so as to support the lid on surface 24. In another embodiment, such pivotal or linearly movable support rods or legs can automatically move to the extended position (as is the case with the illustrated hinge embodiment) by use of an internal mechanism that is actuated when the lid 16 is pivoted to the open position, as will be appreciated by those skilled in the art. By having the support 22 in a none-extended (or proximate) position when the lid 16 is closed, a more compact, ergonomic configuration is provided when the lid 16 is closed.

In this embodiment, the interior space 14 is divided into compartments 49. The compartments 49 will be described in further detail later.

When the lid 16 is in the closed position, as shown in FIG. 1, the support portions 26, 28 may, in one embodiment, be positioned relative to each other so as to lie generally within the same plane (see FIG. 1). In contrast, when the lid 16 is in the open position, as shown in FIG. 2, the support portions 26, 28 may be constructed and arranged to be positioned at an angle A relative to each other, the angle A optionally being 90 degrees or more. The relative orientations can easily be changed, and not limiting, as can be appreciated by those skilled in the art.

In one embodiment, the support 22 is constructed and arranged such that at least a portion of the support 22, such as support portion 26, rests on the surface 24 when the lid 16 is pivoted to the open position. In one embodiment, a portion of the hinge 30 of support 22 rests on the surface 24. In this position, the lid's 16 movement about hinge(s) 20 is constrained by the support 22, and in particular as a result of hinge portion 30 of the support 22 engaging the support surface 24. As a result, in this position, the support 22 is arranged to support the lid 16 to enable the lid 16 to stand upright in the open position, as shown in FIG. 2.

As shown in FIG. 2, the container 10 may include a latch arrangement 18. In this embodiment, the latch arrangement 18 is a latch member constructed and arranged to extend from the lid 16. The lid 16 may have a depression 59 formed therein, wherein the latch member 18 may be connected to the lid 16. The latch member 18 may be attached to the lid 16 by any of several attachment mechanisms, such as welding, bolting, riveting, or any other fastening mechanism. The latch member 18 may optionally be pivotable relative to the lid 16. In one embodiment, the latch member 18 is integrally formed with the lid 16. The latch member 18 may be made of plastic, metal, wood, other materials, or any combination thereof. The latch member 18 may be constructed and arranged to engage with a latch engaging member 58, taking the form of a ledge in this embodiment, on the container portion 12. In the embodiment shown in FIG. 2, the latch engaging member 58 is formed on a portion of the front wall 48 thereof. The engaging member 58 may be, formed within a cutout 61 in the ledge 63. The cutout, 61 may be constructed and arranged to receive the latch member 18 when an engaging portion 62 of the latch member 18 is engaged with the latch engaging member 58. The latch member 18 may include an access portion 60, taking the form of a tab in this embodiment, and the engaging portion 62, taking the form of a lip in this embodiment. The engaging portion 62 may be constructed and arranged to engage with the latch engaging member 58 of the container portion 12 when the lid 16 is latched to the container portion 12. The access portion 60 may be constructed and arranged to enable the user to unlatch the latch 18 by pulling thereon.

To latch the lid 16 to the container portion 12, the user may simply push the lid 16 towards the container portion 12 until the engaging portion 62 touches the latch engaging member 58. Once the engaging portion 62 is pushed against the latch engaging member 58 sufficiently, the engaging portion 62 may snap below the latch engaging member 58. As such, the latch engaging member 58 retains the engaging portion 62 and the lid 16 is unable to be pivoted to the open position. To unlatch the lid 16 from the container portion 12, the user may simply pull the latch member 18 via the access portion 60. By pivoting the access portion 60 in the upwards direction, the engaging portion 62 of the latch member 18 may be disengaged from the engaging member 58 and the lid 16 may be pivoted to the open position.

Figure 3:
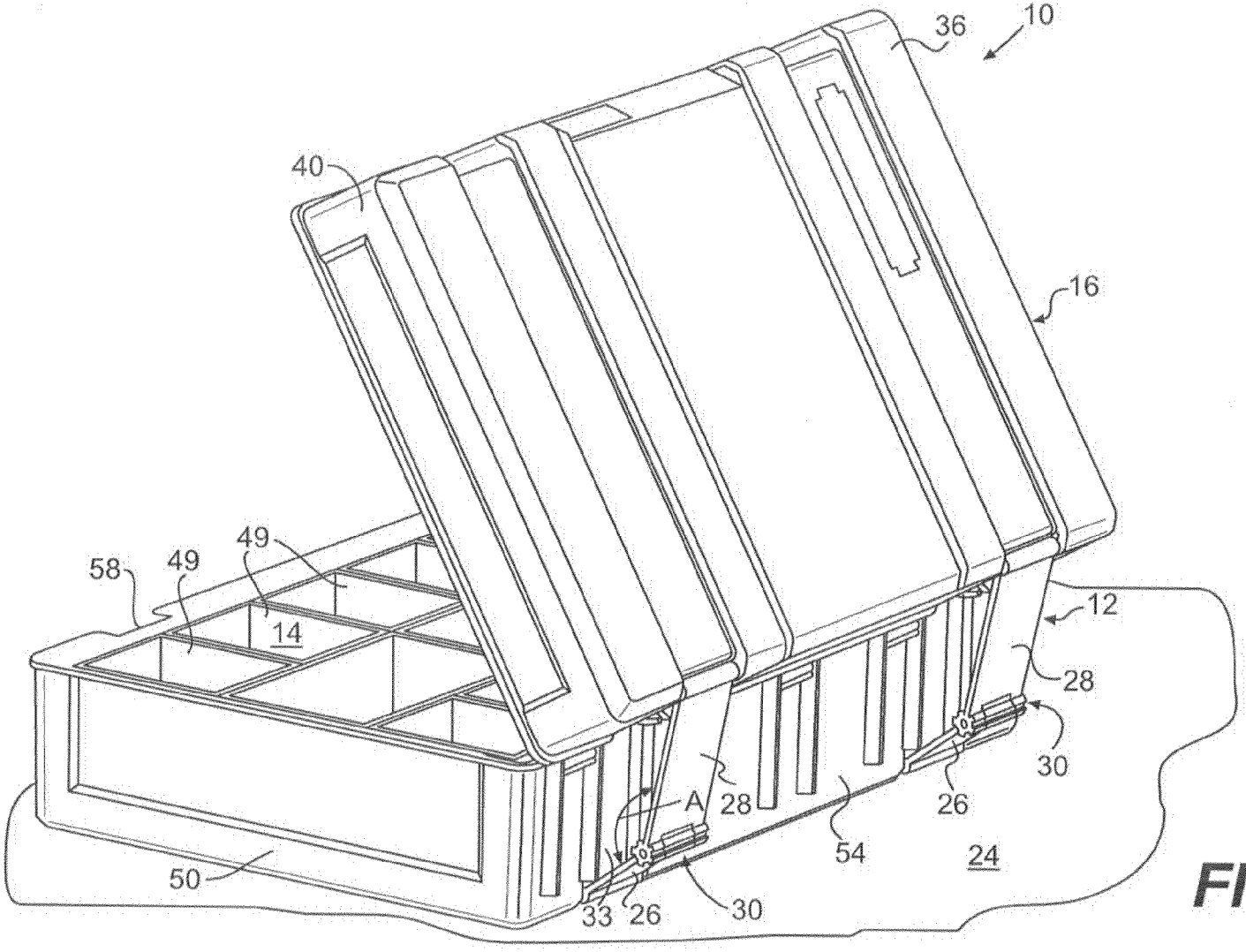
FIG. 3 is a perspective rear view of the organizer in accordance with the embodiment of FIG. 1.

As described previously, in one embodiment, when the lid 16 is in the closed position, the support 22 is in the position as shown in FIG. 1. The support 22 may be pivoted away from the depression 33 (see FIG. 3) as the lid 16 is pivoted to the open position. When the lid 16 is pivoted towards the upright position, the support portions 26, 28 may be pivoted relative to each other so that the angle A formed between support portions 26, 28 decreases. A portion of the support 22 may then rest on the surface 24 so that the lid 16 is supported, thereby enabling the lid 16 to stand upright (as shown in FIG. 2). As such, the configuration of the support 22 in this position prevents the container 10 from tilting backwards.

Figure 4:
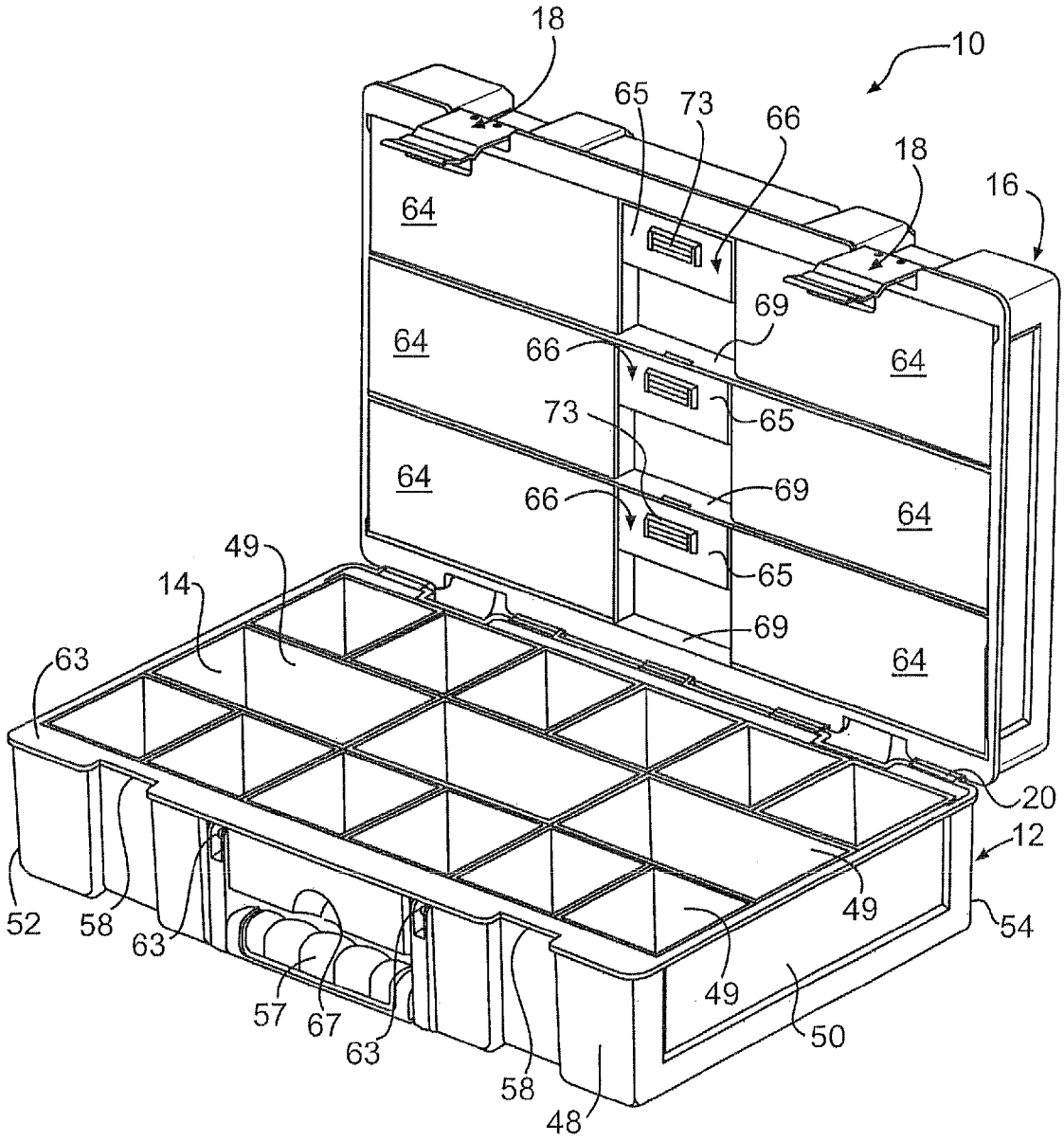
FIG. 4 is a perspective front view of the organizer in an open position in accordance with the embodiment of FIG. 1.

In the embodiment shown in FIG. 4, the container 10 include storage areas in the lid 16. The lid 16 may include dividers or shelves 69 constructed and arranged to attach storage bins 64 thereon. The storage bins 64 may be attached to the dividers 69 or other portions of the container 10 via hinges, pins, snap-fit connections, or other connecting mechanisms. In this embodiment, the container 10 has a plurality of storage bins 64 (six are shown) positioned in the lid 16. The number and configuration of the storage bins 64 may vary in other embodiments. In some embodiments, the lid 16 may be removed from the container portion 10 to be carried separately as a separate container, such as, for example, a toolbox. In some embodiments, a toolbox may be placed in the lid 16 for storage and the toolbox may be removed from the lid 16 to be carried separately.

Figure 5:
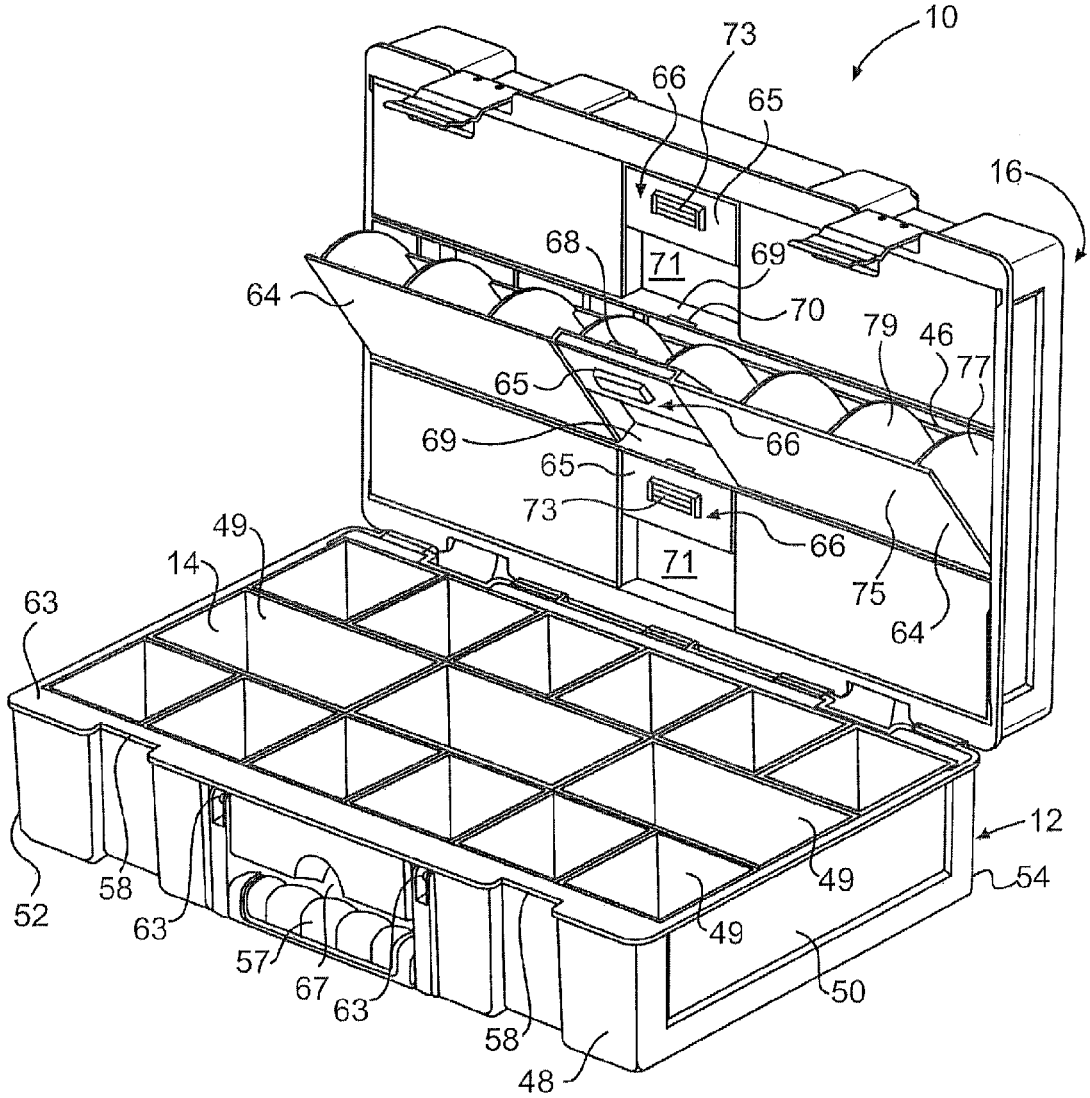
FIG. 5 is a perspective front view of the organizer in an open position in accordance with an embodiment of the present invention.

In the embodiment shown in FIG. 5, the container includes a front panel 75 constructed and arranged to be pivotable relative to the lid 16. The front panel 75 may define a front portion of the storage bins 64 and the latch mechanism 66. At least a portion of the latch mechanism 66, such as a front portion 65 of the latch mechanism 66, may be connected to the front panel 75. The front panel 75 may be an integral piece or may be separate pieces. Dividers or walls 77 may be constructed and arranged to extend perpendicularly from the plane defined by the front panel 75 so as to divide the interior space 79 formed by the front panel 75 and the lid 16 into compartments. These dividers 77 may be received in the interior space 46 of the lid 16 when the storage bins 64 are in the closed position. The latch mechanism 66 may be positioned within a depression 71 formed in the front panel 75. Because the front portion 65 of the latch mechanism 66 is smaller in length than the depression 71, a portion of the depression 71 under the latch mechanism 66 is exposed, thus facilitating access to the latch mechanism 66.

Referring back to FIG. 4, the latch mechanism 66 may be positioned between a pair of storage bins 64. The latch mechanism 66 may be constructed and arranged to enable a user to move the storage bins 64 associated with the latch mechanism 66 to an open position wherein access to the contents of the storage bins 64 is permitted. For example, in the embodiment shown in FIG. 5, the user may pull the latch mechanism 66 by the front portion 65 to pivot its associated pair of storage bins 64 to the open position. It is also contemplated that the storage bins 64 may be constructed and arranged to be slideable such that the user may slide the storage bins 64 to the open position. The latch mechanism 66 may include a latch member 68, taking the form of a protrusion in this embodiment, constructed and arranged to engage with an engaging member 70, taking the form of an opening in this embodiment, located on the divider 69 above the latch mechanism 66 or on a portion of the lid 16.

To latch the storage bins 64 to the closed position so as to prevent access to the contents of the storage bins 64, the user may simply push the storage bins 64 towards the lid 16 until the latch member 68 snaps into the engaging member 70 and is retained by the engaging member 70. To unlatch the storage bins 64 so that the user may move the storage bins 64 to the open position, the user may pivot the latch mechanism 66 upwards in the counterclockwise direction against the bias of an internal spring (not shown), whereupon the latch member 68 is disengaged or removed from the engaging member 70. The user may then pivot the storage bins 64 to the open position. The configuration of the latch member 68 may vary in other embodiments. For example, in one embodiment, at least a portion of the latch mechanism 66 is constructed and arranged to be slideable between its associated pair of storage bins 64 so that the user may slide the latch member 68 downwards to disengage the latch member 68 from the engaging member 70, or the user may slide the latch member 68 upwards to engage the latch member 68 with the engaging member 70. The latch member 68 may optionally be slideable relative to the rest of the latch mechanism 66 so as to enable the latch member 68 to be engaged with or disengaged from the engaging member 70. Ribs 73 may be provided on the front portion 65 of the latch mechanism 66 to facilitate the movement of the latch mechanism 66. In one embodiment, the latch mechanism 66 is connected to the front panel 75 using hinges, pins, snap fit connections, or other connecting mechanisms. In the embodiment wherein the latch member 68 is moveable relative to the fixed portions of the latch mechanism 66, the fixed portions of the latch member 66, such as the front side 65, may be integrally formed with the front panel 75.

Figure 6:
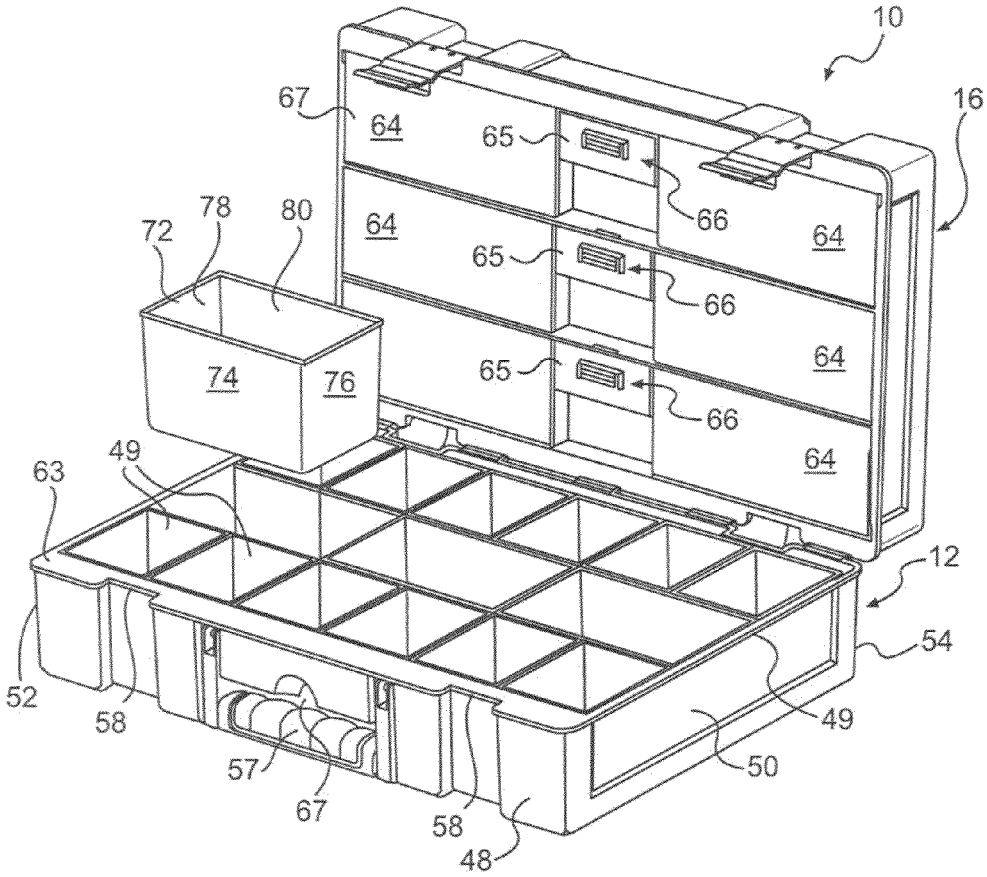
FIG. 6 is a perspective front view of the organizer in an open position in accordance with an embodiment of the present invention.

The compartments 49 of the container 10 are constructed and arranged to be removable (see FIG. 6). As shown in FIG. 6, the compartments 49 may be defined by container member 72. Each container member 72 may comprise a front wall 74, side walls 76, 68, and a back wall 80. The container members 72 may be constructed and arranged to be removable and to be insertable at other locations in the container portion 12 so that the configuration of the compartments 49 may be changed. Container members 72 may also be removed completely from the container portion 12 so that larger compartments 49 may be formed by the walls 48, 50, 52, 54 of the container 10 and/or the walls 74, 76, 78, 80 of the other container members 72. The container members 72 may also be removed to be carried separately. The container members 72 may optionally be shaped differently and/or may have various sizes. The container portion 12 may optionally include inserts made of a flexible or memory-retaining materials with depressions formed therein to receive objects. In some embodiments, the depressions may be the same shape as the tools. In some embodiments, the inserts may be made of foam material.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment may be combined with one or more features of any other embodiment.

What is claimed is:

1. A container comprising:

a container portion with an interior space in which articles to be transported can, be stored;

a lid pivotably connected to the container portion, wherein movement of the lid relative to the container portion between an opened and closed position permits and prevents access to the interior space;

a latch arrangement constructed to secure the lid in covering relation with respect to the container portion;

a hinge structure constructed to enable the lid to pivot relative to the container portion; and a support being constructed and arranged to engage a surface on which a bottom surface rests when the lid is in the opened position, so as to support the lid in the open position, the support being constructed and arranged to be positioned proximate to the container portion when the lid is in the closed position and movable to an extended position when the lid is in the open position, wherein manual force applied to the lid to generate pivotal movement of the lid from the closed position to the opened position is translated to the support during such pivotal movement of the lid so as to force the support from the position proximate to the container portion to the extended position.

2. The container of claim 1, wherein the support comprises a first portion, a second portion, and a hinge constructed and arranged to enable the first portion of the support to pivot relative to the second portion of the support.

3. The container of claim 2, wherein the second portion of the support is constructed and arranged to engage the surface on which the bottom surface rests when the lid is in the opened position.

4. The container of claim 1, further comprising a handle constructed and arranged to enable a user to carry the container.

5. The container of claim 1, further comprising at least one container member.

6. The container of claim 5, wherein the least one container member is removable.

7. The container of claim 5, wherein the at least one container member is constructed and arranged to define compartments.

8. The container of claim 7, wherein the at least one container member is constructed and arranged to enable a user to change the configuration of the compartments defined by the at least one container member.

9. The container of claim 1, further comprising at least one storage bin.

10. The container of claim 9, wherein the at least one storage bin is moveable between an open position allowing access to the contents thereof and a closed position preventing access to the contents thereof.

11. The container of claim 9, wherein the at least one storage bin is pivotable between the open position and closed position.

12. The container of claim 9, wherein the at least one storage bin is located in the lid.

13. The container of claim 9, further comprising a latch mechanism constructed and arranged to latch the at least one storage bin to a portion of the lid.

14. The container of claim 2, wherein the first portion of the support is pivotally connected to the lid portion and the second portion of the support is pivotally connected to the container portion.

* * * * *